US011820128B2

(12) United States Patent
Kishigami

(10) Patent No.: US 11,820,128 B2
(45) Date of Patent: Nov. 21, 2023

(54) LIQUID DISCHARGE APPARATUS, LIQUID DISCHARGE METHOD, AND STORAGE MEDIUM

(71) Applicant: Brother Kogyo Kabushiki Kaisha, Nagoya (JP)

(72) Inventor: Toshihiro Kishigami, Obu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/382,029

(22) Filed: Jul. 21, 2021

(65) Prior Publication Data

US 2022/0024229 A1 Jan. 27, 2022

(30) Foreign Application Priority Data

Jul. 22, 2020 (JP) ..... 2020-125363

(51) Int. Cl.

| | |
|---|---|
| ***B41J 11/00*** | (2006.01) |
| ***B41J 2/435*** | (2006.01) |
| ***B41J 2/145*** | (2006.01) |

(52) U.S. Cl.

CPC ..... *B41J 11/00214* (2021.01); *B41J 2/145* (2013.01); *B41J 2/435* (2013.01); *B41J 11/00218* (2021.01)

(58) Field of Classification Search

CPC ..... B41J 11/00214; B41J 2/145; B41J 2/435; B41J 11/00218; B41J 2/2114; B41J 2/2117; B41J 2/2132

See application file for complete search history.

(56) References Cited

U.S. PATENT DOCUMENTS

| | | | |
|---|---|---|---|
| 2011/0018917 A1 | 1/2011 | Fujisawa et al. | |
| 2015/0231892 A1* | 8/2015 | Mochizuki ..... | B41J 11/00218 347/12 |
| 2017/0028742 A1 | 2/2017 | Ohnishi | |

FOREIGN PATENT DOCUMENTS

| | | |
|---|---|---|
| JP | 2014-231225 A | 12/2014 |
| JP | 2015-116794 A | 6/2015 |

* cited by examiner

*Primary Examiner* — Bradley W Thies
(74) *Attorney, Agent, or Firm* — Banner & Witcoff, Ltd.

(57) ABSTRACT

A liquid discharge apparatus includes: a discharge head; an ultraviolet irradiator disposed at a position different from the discharge head in a first direction; a carriage configured to scan in the first direction; and a controller configured to: control the carriage and the discharge head to execute a first discharge process of discharging the ink on a predefined printing area of the recording medium in a first scan; after the first discharge process, control the carriage and the discharge head to execute a second discharge process of discharging the ink on the predefined printing area in a second scan; after the second discharge process, control the carriage and the ultraviolet irradiator to irradiate the ink discharged on the predefined printing area with the ultraviolet light in a third scan.

18 Claims, 5 Drawing Sheets

LIQUID DISCHARGE APPARATUS, LIQUID DISCHARGE METHOD, AND STORAGE MEDIUM

CROSS REFERENCE TO RELATED APPLICATIONS

The present application claims priority from Japanese Patent Application No. 2020-125363 filed on Jul. 22, 2020, the disclosure of which is incorporated herein by reference in its entirety.

BACKGROUND

The present disclosure relates to a liquid discharge apparatus, a liquid discharge method, and a storage medium that are used in an image recording apparatus such as an ink-jet printer.

In recent years, there has been known printing technology in which an ultraviolet curable ink is discharged on a recording medium. The ultraviolet curable ink is cured and fixed to the recording medium by ultraviolet irradiation executed on ink droplets discharged on the recording medium. The ultraviolet curable ink enables printing, for example, on any other medium than paper, such as resin and metal, thus resulting in the printed matter with gloss.

A printing apparatus used in the printing technology described above is provided with an ultraviolet irradiation unit that irradiates the ultraviolet curable ink with ultraviolet rays (ultraviolet light) to cure the ultraviolet curable ink. When a carriage unit moves a head, the ultraviolet irradiation unit also moves in a head moving direction. Such an ultraviolet irradiation unit is configured by LEDs for ultraviolet irradiation that are arranged in a sub-scanning direction (conveyance direction).

In the above printing apparatus, the ultraviolet irradiation unit is disposed at one side in a main scanning direction.

SUMMARY

As described above, since the ultraviolet irradiation unit is disposed at one side in the main scanning direction in the publicly-known printing apparatus, the ink may be cured or may not be cured with ultraviolet rays immediately after its ink discharge, depending on the moving direction of the head in the main scanning direction. This may make a surface of the recording medium have uneven ink curability.

An object of the present disclosure is to provide a liquid discharge apparatus, a liquid discharge method, and a storage medium that are capable of inhibiting unevenness in ink curability.

According to a first aspect of the present disclosure, there is provided a liquid discharge apparatus, including:

a discharge head including a plurality of nozzles and configured to discharge an ultraviolet curable ink from the nozzles on a recording medium;

an ultraviolet irradiator disposed at a position different from the discharge head in a first direction and configured to irradiate the ink discharged on the recording medium with ultraviolet light;

a carriage configured to scan in the first direction, the discharge head and the ultraviolet irradiator being carried on the carriage and a controller configured to control the discharge head, the ultraviolet irradiator, and the carriage, wherein the controller is configured to:

control the carriage and the discharge head to execute a first discharge process of discharging the ink on a predefined printing area of the recording medium in a first scan in which the carriage scans in the first direction;

after the first discharge process, control the carriage and the discharge head to execute a second discharge process of discharging the ink on the predefined printing area, on which the ink has been discharged by the first discharge process, in a second scan in which the carriage scans in the first direction, the second scan being different from the first scan;

after the second discharge process, control the carriage and the ultraviolet irradiator to irradiate the ink discharged on the predefined printing area by the first discharge process and the second discharge process with the ultraviolet light in a third scan in which the carriage scans in the first direction, the third scan being different from the second scan.

According to a second aspect of the present disclosure, there is provided a method for discharging liquid by use of a liquid discharge apparatus including: a discharge head configured to discharge an ultraviolet curable ink on a recording medium; an ultraviolet irradiator disposed at a position different from the discharge head in a first direction and configured to irradiate the ink discharged on the recording medium with ultraviolet light; and a carriage configured to scan in the first direction, the discharge head and the ultraviolet irradiator being carried on the carriage, the method including:

discharging the ink from the discharge head on a predefined printing area of the recording medium in a first scan in which the carriage scans in the first direction;

after the discharging of the ink in the first scan, discharging the ink from the discharge head on the predefined printing area, on which the ink has been discharged in the first scan, in a second scan in which the carriage scans in the first direction, the second scan being different from the first scan; and after the discharging of the ink in the second scan, irradiating the ink discharged on the predefined printing area by discharging of the ink in the first scan and second scan with the ultraviolet light in a third scan in which the carriage scans in the first direction, the third scan being different from the second scan.

According to a third aspect of the present disclosure, there is provided a non-transitory computer-readable storage medium storing a computer-executable liquid discharge program for a liquid discharge apparatus including: a discharge head including a plurality of nozzles and configured to discharge an ultraviolet curable ink from the nozzles on a recording medium; an ultraviolet irradiator disposed at a position different from the discharge head in a first direction and configured to irradiate the ink discharged on the recording medium with ultraviolet light; a carriage configured to scan in the first direction, the discharge head and the ultraviolet irradiator being carried on the carriage; and a controller configured to control the discharge head, the ultraviolet irradiator, and the carriage, the program causing the controller to:

control the carriage and the discharge head to execute a first discharge process of discharging the ink on a predefined printing area of the recording medium in a first scan in which the carriage scans in the first direction;

after the first discharge process, control the carriage and the discharge head to execute a second discharge process of discharging the ink on the predefined printing area on which the ink has been discharged by the first discharge process, in a second scan in which the carriage scans in the first direction, the second scan being different from the first scan; and after the second discharge process, control the carriage and the ultraviolet irradiator to irradiate the ink discharged on the predefined printing area by the first discharge process and the second discharge process with the ultraviolet light in a third scan in which the carriage scans in the first direction, the third scan being different from the second scan.

The technique disclosed in the present specification can be achieved in a variety of embodiments. For example, the technique disclosed in the present specification can be achieved in a liquid discharge apparatus, a liquid discharge method, a computer program for achieving functions of the apparatus and the method, a storage medium storing the computer program, and the like.

BRIEF DESCRIPTION OF THE DRAWINGS

FIGS. 4A to 4F, illustrate a first discharge process, a second discharge process, and an irradiation process.

DETAILED DESCRIPTION

Figure 1:
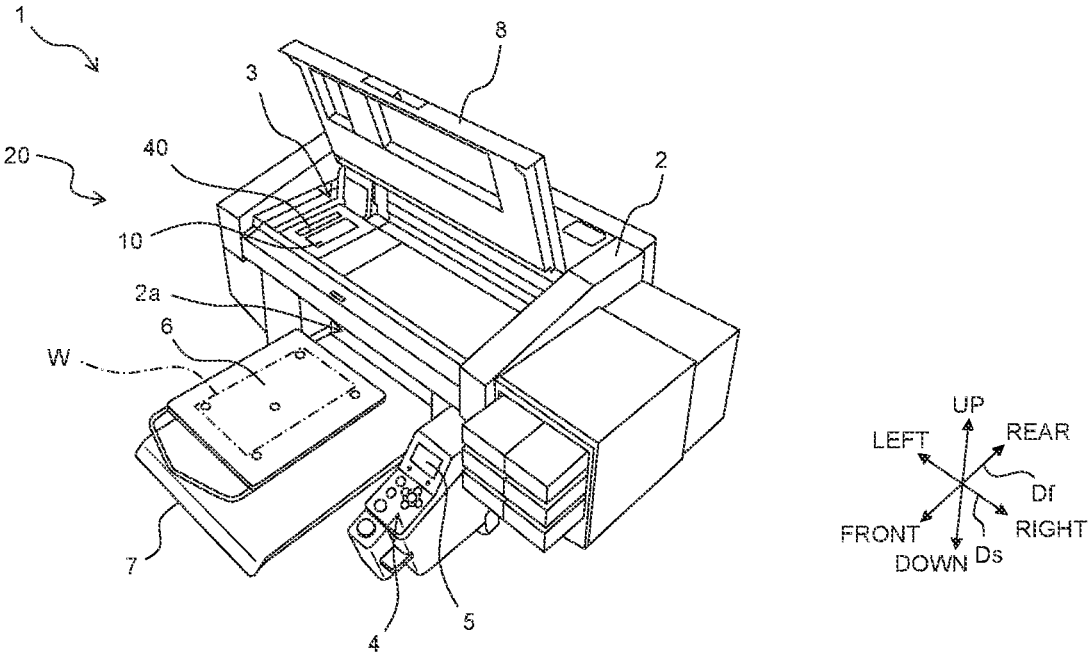
FIG. 1 is a perspective view of an image recording apparatus provided with a liquid discharge apparatus.

Referring to the drawings, the following explanation is made about a liquid discharge apparatus and an image recording apparatus provided with the liquid discharge apparatus according to an embodiment of the present disclosure. The liquid discharge apparatus and the image recording apparatus described below are merely an embodiment of the present disclosure. Thus, the present disclosure is not limited to the following embodiment. It is possible to make addition, deletion, and modification within a range without deviating from the gist or essential characteristics of the present disclosure.

FIG. 1 is a perspective view of an image recording apparatus 1 provided with a liquid discharge apparatus 20 according to the embodiment of the present disclosure. In FIG. 1, directions orthogonal to each other are an up-down direction, a left-right direction (first direction), and a front-rear direction (second direction). The left-right direction is a main scanning direction Ds. The front-rear direction is a sub-scanning direction Df (corresponding to a conveyance direction of a recording medium W) orthogonal to the main scanning direction Ds. The image recording apparatus 1 is capable of executing printing on various kinds of printing mediums W, such as printing sheets and impermeable mediums including resin, metal, and the like.

Figure 2:
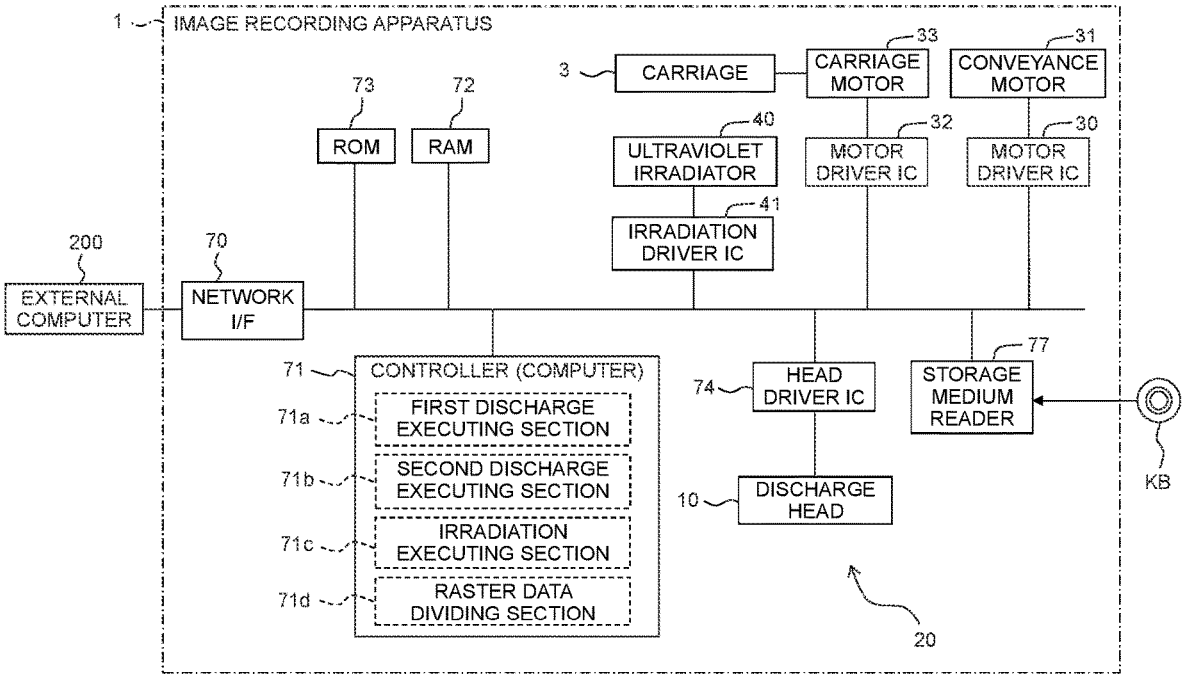
FIG. 2 is a block diagram of a configuration of the image recording apparatus in FIG. 1.

As depicted in FIG. 1, the image recording apparatus 1 according to this embodiment includes a casing 2, operation keys 4, a display 5, a platen 6, a tray 7, an upper cover 8, and the liquid discharge apparatus 20. The liquid discharge apparatus 20 includes a carriage 3, a discharge head 10 of, for example, a serial head type, an ultraviolet irradiator 40, and a controller (computer) 71 (FIG. 2). A mechanical configuration of the controller 71 is described below.

The casing 2 is formed, for example, in a box shape. In the casing 2, a front surface is provided with an opening 2*a* and a back surface is provided with an opening (not depicted). The operation keys 4 are provided at the right-front side in the casing 2. The display 5 is provided at the rear side of the operation keys 4. The operation keys 4 receive operation input performed by a user. The display 5 is formed, for example, by a touch panel. The display 5 displays predefined information. Part of the display 5 also functions as operation keys at a predefined timing. The controller 71 controls a display of the display 5 and achieves a printing function based on input from the operation keys 4 or external input via a network interface 70 described below.

The carriage 3 is configured to reciprocate in the main scanning direction Ds. That is, the carriage 3 is configured to scan in the main scanning direction Ds. In this embodiment, the discharge head 10 and the ultraviolet irradiator 40 are carried on the carriage 3. Thus, the discharge head 10 and the ultraviolet apparatus 40 can also reciprocate in the main scanning direction Ds. An ink-jet head that discharges, for example, an ultraviolet curable ink on the recording medium W is used as the discharge head 10. The discharge head 10 includes, for example, four nozzle rows arranged in the main scanning direction Ds. Each nozzle row includes nozzles aligned in the sub-scanning direction Df at regular intervals. The ultraviolet curable ink is discharged from the nozzles. Inks discharged from the nozzles of the respective nozzle rows of the discharge head 10 are a yellow ink (Y), a magenta ink (M), a cyan ink (C), and a black ink (K) that may be collectively referred to as, for example, color inks. The kinds of inks discharged are not limited to the above. For example, any other ink such as a clear ink or a white ink may be discharged.

The discharge head 10 and the ultraviolet irradiator 40 are arranged in the main scanning direction Ds. That is, a position in the main scanning direction Ds of the ultraviolet irradiator 40 is different from a position in the main scanning direction Ds of the discharge head 10. Specifically, the ultraviolet irradiator 40 is disposed at the left side of the discharge head 10 in the main scanning direction Ds. The ultraviolet irradiator 40 includes light-emitting diode chips that emit ultraviolet rays (ultraviolet light), and irradiates the ink discharged on the recording medium W by the discharge head 10 with ultraviolet rays to cure the ink. The light-emitting diode chips react a photopolymerization initiator in the ink by irradiating the ink with ultraviolet rays. The reaction of photopolymerization initiator polymerizes monomers in the ink, thus curing the ink. The light-emitting diode chips fix the ink to the recording medium W. The light-emitting diode chips are arranged, for example, in a matrix form.

The platen 6 is configured so that the recording medium W is placed thereon. The platen 6 has a predefined thickness and is formed, for example, by a rectangular plate material of which longitudinal direction is the sub-scanning direction Df. The platen 6 is removably supported by a platen support base (not depicted). The platen support base is configured to be movable between a printing position in which printing is executed on the recording medium W and a taken-out position in which the recording medium W is taken out of the platen 6. In the printing position, the platen 6 faces the discharge head 10. In the taken-out position, the platen support base is positioned outside the casing 2 and the recording medium W can be placed on the platen 6. In printing, the platen 6 moves in the sub-scanning direction Df (i.e., conveyance direction), and the recording medium W placed on the platen 6 is also conveyed in the conveyance direction.

The tray 7 is provided below the platen 6. The tray 7 has a predefined thickness and is formed, for example, by a rectangular plate material of which longitudinal direction is the sub-scanning direction Df. Holding a front portion of the upper cover 8 up causes the upper cover 8 to pivot upward with its base end configured to be pivotable as a fulcrum. This exposes the inside of the casing 2.

Referring to FIG. 2, explanation is made about any other configuration of the image recording apparatus 1 provided with the liquid discharge apparatus 20 according to this embodiment.

As depicted in FIG. 2, the image recording apparatus 1 of this embodiment includes, in addition to the above parts or components, the network interface 70, the controller 71 formed by a CPU or the like, a RAM 72, a ROM 73, a head driver IC 74, a storage medium reader 77, a motor driver IC 30, a motor driver IC 32, a conveyance motor 31, a carriage motor 33, the ultraviolet irradiator 40, and an irradiation driver IC 41. The conveyance motor 31 causes the platen 6 (conveyor of the present disclosure) to operate, conveying the recording medium W in the conveyance direction (i.e., the sub-scanning direction Df) orthogonal to a moving direction of the carriage 3 (i.e., the main scanning direction Ds). The controller 71 corresponds to a computer of the present disclosure.

The controller 71 executes a discharge process in which ink is discharged by the discharge head 10 and a movement process in which the carriage 3 is moved in the main scanning direction Ds. In order to achieve these functions, the controller 71 includes a first discharge executing section 71*a*, a second discharge executing section 71*b*, an irradiation executing section 71*c*, and a raster data dividing section 71*d*. The functions of the first discharge executing section 71*a*, the second discharge executing section 71*b*, the irradiation executing section 71*c*, and the raster data dividing section 71*d* are achieved by causing the controller 71 to execute a predefined liquid discharge program. The first discharge executing section 71*a* executes a first discharge process described below, the second discharge executing section 71*b* executes a second discharge process described below, and the irradiation executing section 71*c* executes an irradiation process described below. In the following, processes including the first discharge process, the second discharge process, and the irradiation process are collectively referred to as surface uniformizing printing. The first discharge executing section 71*a* corresponds to a first discharge executing means, the second discharge executing section 71*b* corresponds to a second discharge executing means, and the irradiation executing section 71*c* corresponds to an irradiation executing means. In the following, explanation is made about functions of respective parts or components of the controller 71.

The first discharge executing section 71*a* executes the first discharge process on a predefined printing area R1 (FIG. 4) of the recording medium W. In the first discharge process, the carriage 3 is moved in the main scanning direction Ds (a first scan) and the discharge process is executed by the discharge head 10 when the carriage 3 is moved. The first discharge executing section 71*a* causes the head driver IC 74 to control the operation of the discharge head 10 based on raster data for the first discharge process, thereby discharging ink droplets to form an image in the predefined printing area R1 of the recording medium W. Along with this, the first discharge executing section 71*a* causes the motor driver IC 32 to control the operation of the carriage motor 33, thereby executing the scan of the carriage 3.

After the first discharge process, the second discharge executing section 71*b* executes the second discharge process on the predefined printing area R1. In the second discharge process, scan (a second scan) of the carriage 3 different from that in the first discharge process is executed and the discharge process is executed by the discharge head 10 when the second scan of the carriage 3 is executed. The second discharge executing section 71*b* causes the head driver IC 74 to control the operation of the discharge head 10 based on raster data for the second discharge process, thereby discharging ink droplets to form the image in the predefined printing area R1 of the recording medium W. Along with this, the second discharge executing section 71*b* causes the motor driver IC 32 to control the operation of the carriage motor 33, thereby executing the scan of the carriage 3 different from that in the first discharge process.

After the second discharge process, the irradiation executing section 71*c* executes the irradiation process on the predefined printing area R1. In the irradiation process, scan (a third scan) of the carriage 3 different from that in the second discharge process is executed and the ultraviolet irradiator 40 irradiates the ink discharged in the first discharge process and the second discharge process with ultraviolet rays when the scan (movement) of the carriage 3 is executed. The irradiation executing section 71*c* causes the irradiation driver IC 41 to control the operation of the ultraviolet irradiator 40, thereby irradiating the predefined printing area R1 with ultraviolet rays. Along with this, the irradiation executing section 71*c* causes the motor driver IC 32 to control the operation of the carriage motor 33, thereby executing the scan of the carriage 3 different from those in the first discharge process and the second discharge process. Details of the processes executed by the first discharge executing section 71*a*, the second discharge executing section 71*b*, and the irradiation executing section 71*c* are described below while referring to the drawings.

Here, in this embodiment, the controller 71 receives a printing job transmitted from an external computer 200 via the network interface 70. Information in which a flag of the surface uniformizing printing is on is written in a header of the printing job. The raster data dividing section 71*d* refers to the flag that is written in the header of the printing job and that designates the surface uniformizing printing. When the flag designating the surface uniformizing printing is on, the raster data dividing section 71*d* divides the raster data for discharging ink droplets to form the image on the recording medium W into raster data for the first discharge process and raster data for the second discharge process. The raster data for the first discharge process and the raster data for the second discharge process are thus generated.

The RAM 72 temporarily stores the printing job transmitted from the computer 200 such as an external personal computer via the network interface 70. The RAM 72 temporarily stores printing data for each pass (data for printing to be executed for each scan of the carriage).

The ROM 73 stores a control program(s) for executing the liquid discharge program and various data processes according to this embodiment.

When receiving an instruction from the controller 71, the head driver IC 74 controls operation that causes the discharge head 10 to discharge ink. Similarly, when receiving an instruction from the controller 71, the motor driver IC 30 controls drive of conveyance motor 31, When receiving an instruction from the controller 71, the motor driver IC 32 controls drive of the carriage motor 33. When receiving an instruction from the controller 71, the irradiation driver IC 41 controls operation that causes the ultraviolet irradiator 40 to irradiate ink with ultraviolet rays.

The storage medium reader 77 is an apparatus that reads data of the liquid discharge program from a computer readable storage medium KB such as a flexible disk, CD (CD-ROM, CD-R, CD-RW, and the like), DVD (DVD-ROM, DVD-RAM, DVD-R, DVD+R, DVD-RW, DVD+RW, and the like), a Blu-ray disc, a magnetic disk, an optical disk, and a magneto-optical disk. The storage medium reader 77 may be an apparatus that reads data of an image recording program from a storage medium such as a USB flash memory. The data of the liquid discharge program read from the recording medium is saved in the RAM 72, and the data is executed by the controller 71. The data of the liquid discharge program according to this embodiment may be read from the external computer 200 via the network interface 70 and may be saved in the RAM 72. Or, the data of the liquid discharge program according to this embodiment may be downloaded from the Internet and may be saved in the RAM 72.

Figure 3:
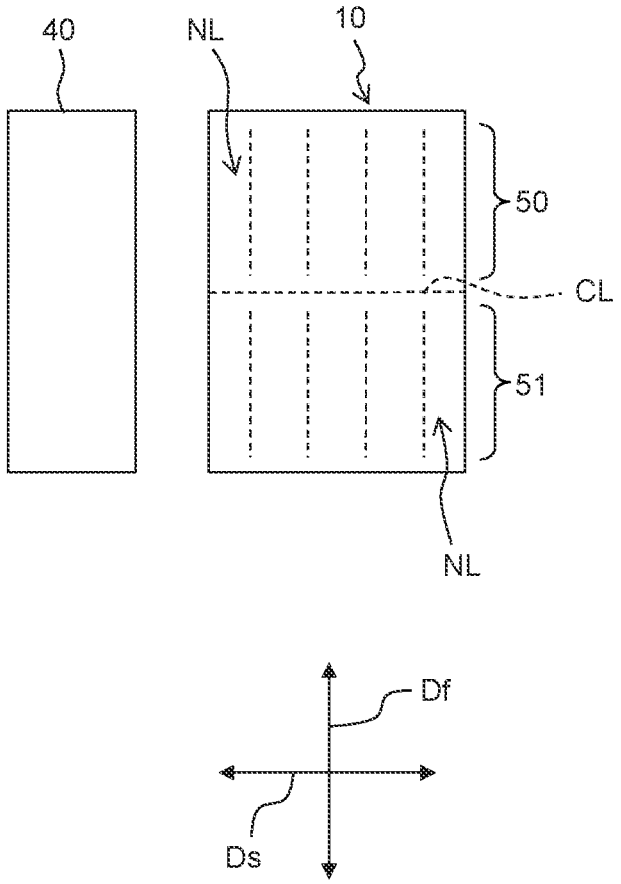
FIG. 3 depicts a first nozzle group and a second nozzle group of a discharge head.

Subsequently, the discharge head 10 according to this embodiment is explained. As depicted in FIG. 3, the discharge head 10 according to this embodiment includes a first nozzle group 50 and a second nozzle group 51. The first nozzle group 50 and the second nozzle group 51 are arranged side by side in the sub-scanning direction Df (i.e., conveyance direction). A position in the conveyance direction of the second nozzle group 51 is different from that of the first nozzle group 51. Specifically, the second nozzle group 51 is arranged at a downstream side in the conveyance direction of the first nozzle group 50. A boundary CL between the first nozzle group 50 and the second nozzle group 51 is set to a center (center portion) of an entire length of nozzle rows NL, each of which is formed by the nozzles aligned in the conveyance direction in the discharge head 10 (center portion in the sub-scanning direction Df of the nozzle rows NL).

The first nozzle group 50 includes, for example, four nozzle rows NL. Similarly, the second nozzle group 51 includes four nozzle rows NL. The nozzle rows NL are arranged in the main scanning direction Ds at regular intervals. The positions in the main scanning direction Ds of the respective nozzle rows NL in the first nozzle group 50 are same as those in the second nozzle group 51. In each of the first nozzle group 50 and the second nozzle group 51, each of the nozzle rows NL includes nozzles aligned in the sub-scanning direction Df at regular intervals.

In the first discharge process, the controller 71 causes the discharge head 10 to execute the discharge process by use of the first nozzle group 50 when the carriage 3 is moved. In the second discharge process, the controller 71 causes the discharge head 10 to execute the discharge process by use of the second nozzle group 51 when the carriage 3 is moved with the irradiation process by the ultraviolet irradiator 40 being stopped. Details thereof are explained below.

Referring to the drawings, a method of inhibiting the unevenness of ink curability according to this embodiment is explained below.

Figure 4A:
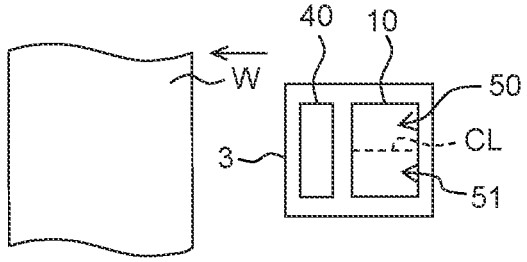

FIGS. 4A to 4E illustrate the first discharge process, the second discharge process, and the irradiation process. In an initial state, the carriage 3 waits at the right side in the main scanning direction Ds of the recording medium W, as depicted in FIG. 4A.

Figure 4B:
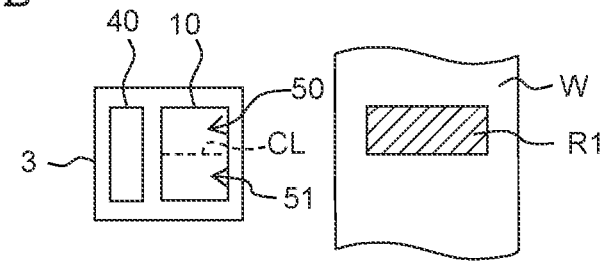

Subsequently, as depicted in FIG. 4B, the controller 71 executes the first discharge process in which ink is discharged from the first nozzle group 50 of the discharge head 10 when the carriage 3 is moved from the right side to the left side in the main scanning direction Ds (the first scan in which the carriage scans from one side (a first side) to the other side (a second side) in the first direction) with respect to the predefined printing area R1 of the recording medium W. Ink is thus discharged on the predefined printing area R1 of the recording medium W. The ultraviolet irradiator 40 passes over the recording medium W before the discharge head 10 when the carriage 3 is moved in the first discharge process. Since the ultraviolet irradiator 40 passes over the recording medium W before the discharge head 10 in the process of FIG. 4B, the ink discharged from the discharge head 10 is not cured even when the irradiation operation of the ultraviolet irradiator 40 is not stopped (i.e., the ultraviolet irradiator 40 is not turned off). However, in order to reduce power consumption, the irradiation operation of the ultraviolet irradiator 40 is desirably stopped when the carriage 3 is moved in the first discharge process.

Figure 4C:
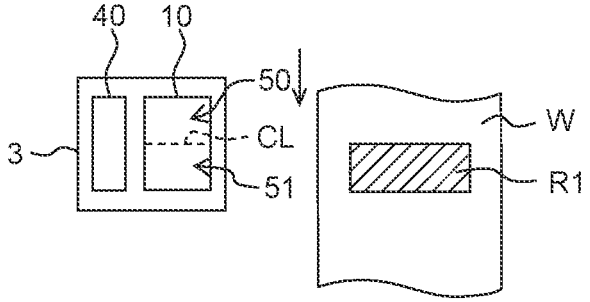

Subsequently, as depicted in FIG. 4C, the controller 71 executes the conveyance process to move the recording medium W so that the predefined printing area R1 moves to an ink discharge range for the second nozzle group 51 of the discharge head 10. Specifically, after the first discharge process is completed and before the second discharge process is started, the controller 71 causes the conveyance motor 31 to convey the recording medium W by a distance corresponding to a length in the conveyance direction of the first nozzle group 50. This conveys the recording medium W downward in the conveyance direction, and the predefined printing area R1 moves to the ink discharge range for the second nozzle group 51 of the discharge head 10.

Figure 4D:
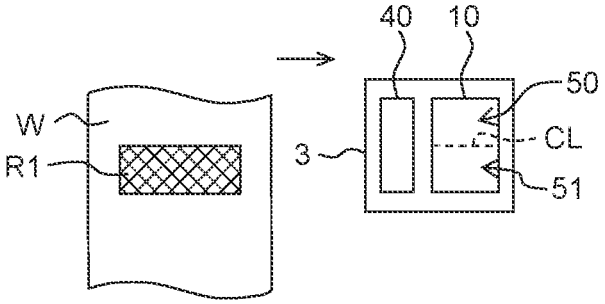

Subsequently, as depicted in FIG. 4D, the controller 71 executes the second discharge process in which ink is discharged from the second nozzle group 51 of the discharge head 10 on the predefined printing area R1 of the recording medium W when the carriage 3 is moved from the left side to the right side in the main scanning direction Ds (the second scan in which the carriage scans from the other side (the second side) to the one side (the first side) in the first direction). The moving direction in the main scanning direction Ds of the carriage 3 in FIG. 4D is opposite to that in FIG. 4B. Ink is thus discharged again on the predefined printing area R1 of the recording medium W. Ink discharged by the first discharge process and ink discharged by the second discharge process overlap with each other in the predefined printing area R1 of the recording medium W. The ultraviolet irradiator 40 passes over the recording medium W after the discharge head 10 when the carriage 3 is moved in the second discharge process. Since the ultraviolet irradiator 40 passes over the recording medium W after the discharge head 10 in the process of FIG. 4D, and since a certain time needs to be left after the ink discharge, the irradiation operation of the ultraviolet irradiator 40 is stopped when the ink discharge is executed by the discharge head 10 in FIG. 4D.

Figure 4E:
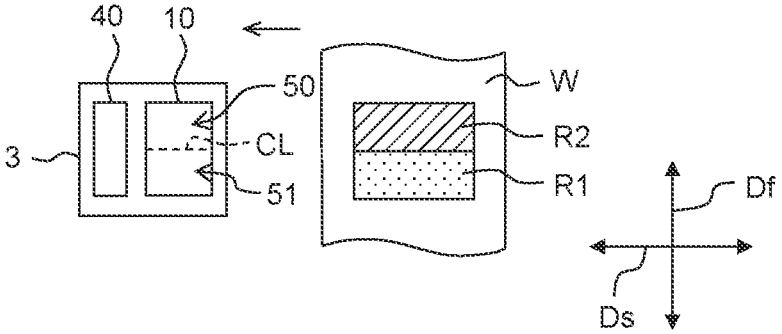

Subsequently, as depicted in FIG. 4E, the controller 71 executes the irradiation process in which the ultraviolet irradiator 40 irradiates the predefined printing area R1 of the recording medium W with ultraviolet rays when the carriage 3 is moved from the right side to the left side in the main scanning direction Ds (the third scan in which carriage scans from the one side (the first side) to the other side (the second side) in the first direction). The moving direction in the main scanning direction Ds of the carriage 3 in FIG. 4E is opposite to that in FIG. 4D. Ink in the printing area R1 thus cures. Further, in the irradiation process, the controller 71 executes the discharge process in which ink is discharged from the first nozzle group 50 of the discharge head 10 on an area R2 of the recording medium W that is different from the predefined printing area R1 and that is at an upstream side in the conveyance direction of the printing area R1. Ink is thus discharged on the area R2 of the recording medium W that is different from the printing area R1. Accordingly, the controller 71 stops the conveyance of the recording medium W between the second discharge process and the irradiation process. In this embodiment, the first scan and the second scan are executed toward the opposite sides in the first direction, and the first scan and the third scan are executed toward the same side in the first direction. No scan is executed by the carriage 3 between the first scan and the second scan. No scan is executed by the carriage 3 between the second scan and the third scan.

As described above, in this embodiment, ink discharged by the first discharge process is not irradiated with ultraviolet rays immediately after the ink discharge, and ink discharged by the second discharge process is not irradiated with ultraviolet rays immediately after the ink discharge. Thus, the aspect of the ultraviolet irradiation according to this embodiment is different from conventional aspects in which ink is irradiated with ultraviolet rays immediately after ink lands on the recording medium W. Here, the wording "ink is irradiated with ultraviolet rays immediately after ink lands on the recording medium W" means, for example, that both ink discharge and ultraviolet irradiation are executed, when the carriage is moved so that the discharge head 10 and the ultraviolet irradiator 40 pass over the recording medium W in this order. Although the discharge head 10 and the ultraviolet irradiator 40 pass over the recording medium W in this order in the second scan of the second discharge process according to this embodiment, the irradiation process of the ultraviolet irradiator 40 is stopped in the second scan. This avoids a situation in which ink is irradiated with ultraviolet rays immediately after ink lands on the recording medium W.

Referring to the flowchart of FIG. 5, a priming process executed by the image recording apparatus 1 according to this embodiment is explained below. The printing process indicated in the flowchart starts when the image recording apparatus 1 is turned on. Since the details of the process are described above, explanation thereof is made simply here.

Figure 5:
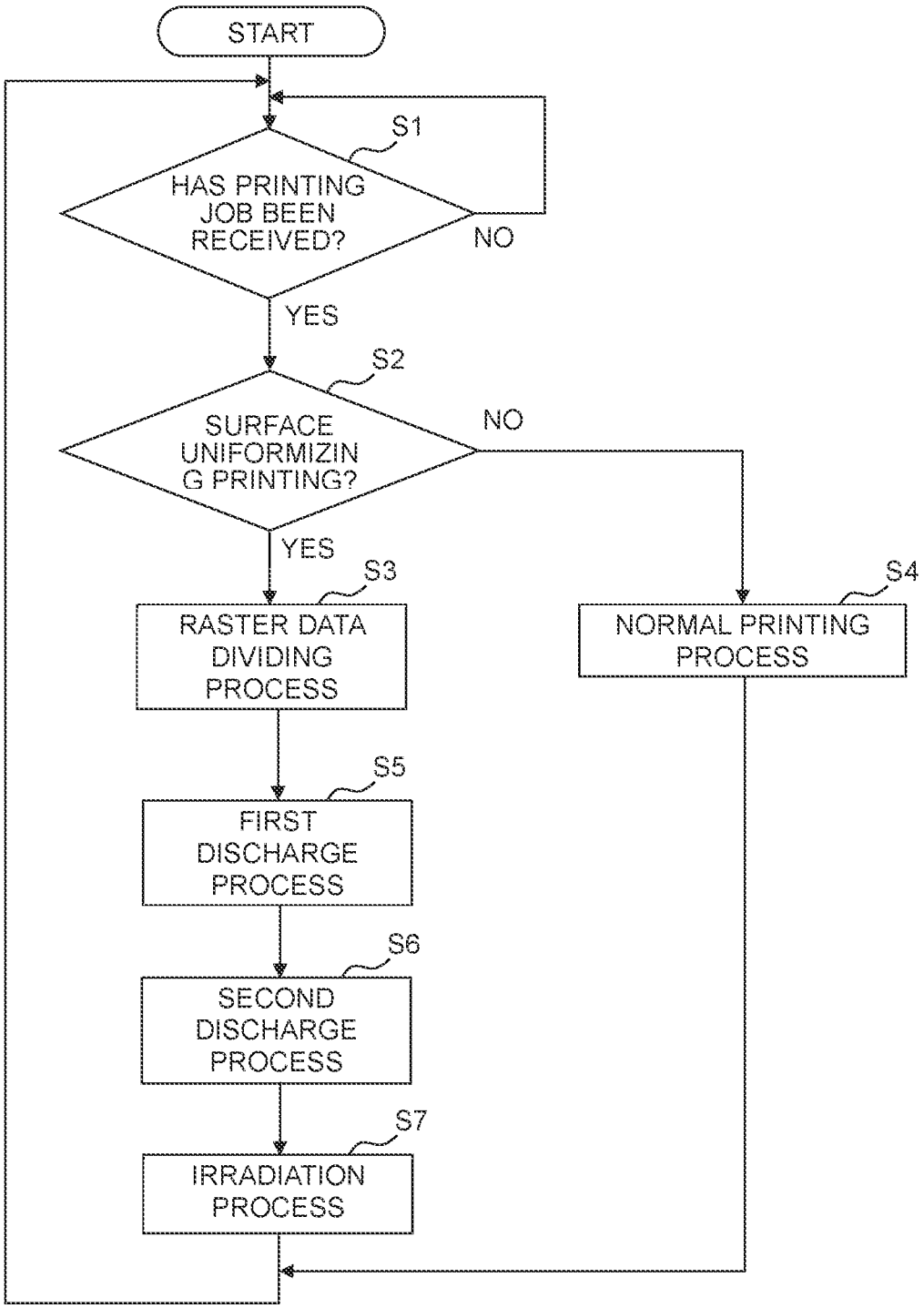
FIG. 5 is a flowchart of a printing process executed by the image recording apparatus in FIG. 1.

As indicated in FIG. 5, the controller 71 first determines whether the controller 71 has received a printing job transmitted from the external computer 200 via the network interface 70 (S1). When the controller 71 has not yet received the printing job (S1: No), the controller 71 waits until the controller 71 receives the printing job.

When the controller 71 has received the printing job (S1: Yes), the controller 71 refers to the flag of the surface uniformizing printing written in the header of the printing job received, and determines whether the flag is on (S2). When the flag of the surface uniformizing printing is on (S2: Yes), the controller 71 executes a raster data dividing process (S3). When the flag of the surface uniformizing printing is not on (S2: No), the controller 71 executes a normal printing process (S4). After the process S4, the controller 71 returns to the process S1 and waits for the next printing job.

After the process S3, the controller 71 executes the first discharge process (S5). After the first discharge process, the controller 71 executes the second discharge process (S6) and then executes the irradiation process (S7). After the process S7, the controller 71 returns to the process S1 and waits for the next printing job.

According to this embodiment, in each of the first discharge process and the second discharge process, the liquid discharge apparatus 20 executes the movement of the carriage 3 in the main scanning direction Ds with respect to the same printing area R1 of the recording medium W and executes the discharge process by the discharge head 10 on the same printing area R1 of the recording medium W when the carriage 3 is moved. Specifically, the discharge process by use of the first nozzle group 50 of the discharge head 10 is executed when the carriage 3 is moved in the first discharge process, and the discharge process by use of the second nozzle group 51 of the discharge head 10 is executed when the carriage 3 is moved in the second discharge process. In the irradiation process, the carriage 3 is moved with respect to the same printing area R1 and the irradiation process by the ultraviolet irradiator 40 is executed on the same printing area R1 when the carriage 3 is moved. This eliminates a conventional problem, that is, a case where ink is cured immediately after ink discharge and a case where ink is not cured immediately after ink discharge are caused. It is thus possible to inhibit the unevenness of ink curability, thereby making it possible to inhibit the unevenness of gloss of the printed matter.

In this embodiment, the discharge process by use of the second nozzle group 51 of the discharge head 10 is executed when the carriage 3 is moved in the second discharge process with the irradiation process by the ultraviolet irradiator 40 being stopped. It is thus possible to avoid a situation in which ink is cured with ultraviolet rays from the ultraviolet irradiator 40 immediately after ink is discharged from the second nozzle group 51 of the discharge head 10.

In this embodiment, the ultraviolet irradiator 40 passes over the recording medium W before the discharge head 10 when the carriage 3 is moved in the first discharge process. Further, the ultraviolet irradiator 40 passes over the recording medium W after the discharge head 10 when the carriage 3 is moved in the second discharge process. In this configuration, ink is not cured even when the ultraviolet irradiator 40 is turned on in the first discharge process, and ink immediately after ink discharge is inhibited from being cured with ultraviolet rays from the ultraviolet irradiator 40 by turning off the ultraviolet irradiator 40 in the second discharge process.

In this embodiment, the boundary between the first nozzle group 50 and the second nozzle group 51 is set to the center portion of the entire length of the nozzle rows NL, each of which is formed by the nozzles aligned in the conveyance direction in the discharge head 10 (center portion in the sub-scanning direction Df of the nozzle rows NL). This makes it easy to execute printing on the same printing area R1 of the recording medium W twice (i.e., in the first discharge process and the second discharge process).

In this embodiment, after the first discharge process is completed and before the second discharge process is started, the controller 71 causes the conveyance motor 31 to convey the recording medium W by the distance corresponding to the length in the conveyance direction of the first nozzle group 50. Thus, when the second discharge process is executed, the printing area R1 for which printing has been executed in the first discharge process is positioned in the ink discharge range for the second nozzle group 51 of the discharge head 10.

In this embodiment, the irradiation operation of the ultraviolet irradiator 40 is stopped when the carriage 3 is moved in the first discharge process. This reduces power consumption.

In the irradiation process according to this embodiment, the controller 71 executes the discharge process in which ink is discharged from the first nozzle group 50 of the discharge head 10 on the area R2 of the recording medium W that is different from the predefined printing area R1 of the recording medium W and that is positioned at the upstream side in the conveyance direction of the printing area R1. Since ink is discharged also on the area R2 of the recording medium W that is different from the printing area R1, the printing time is reduced.

In this embodiment, the controller 71 stops the conveyance of the recording medium W between the second discharge process and the irradiation process. The boundary between the image formed by the first discharge process and the image formed by the second discharge process is thus inhibited from having uneven of the ink which may otherwise be caused by a conveyance error.

In this embodiment, when the flag designating the surface uniformizing printing in the printing job is on, the controller 71 executes the first discharge process, the second discharge process, and the irradiation process. This makes it possible to execute the surface uniformizing printing only when a user desires to execute the surface uniformizing printing.

In this embodiment, when the flag designating the surface uniformizing printing in the printing job is on, the raster data dividing section 71*d* divides the raster data, which is used to discharge ink droplets to form the image on the recording medium W, into pieces of raster data respectively corresponding to the first discharge process and the second discharge process. It is thus possible to generate the raster data for the first discharge process and the raster data for the second discharge process.

As described above, the present disclosure can provide the liquid discharge apparatus, the liquid discharge method, and the storage medium storing the liquid discharge program that are capable of inhibiting the unevenness of gloss of the printed matter.

Modified Examples

The present disclosure is not limited to the above embodiment, and the present disclosure can be modified or changed without departing from the gist and/or scope of the present disclosure.

In the above embodiment, the discharge head 10 includes the four nozzle rows NL from which the ultraviolet curable ink is discharged. The present disclosure, however, is not limited thereto. The discharge head 10 may include, for example, two nozzle rows NL. In this case, any other ultraviolet curable ink such as clear ink or white ink may be discharged.

In the above embodiment, the irradiation operation of the ultraviolet irradiator 40 is stopped when the carriage 3 is moved in the first discharge process in order to reduce power consumption. The present disclosure, however, is not limited thereto. The ultraviolet irradiator 40 may be turned on when the carriage 3 is moved in the first discharge process.

In the above embodiment, the ultraviolet irradiator 40 is disposed at the left side of the discharge head 10 in the main scanning direction Ds. The present disclosure, however, is not limited thereto. It is only required that the position of the ultraviolet irradiator 40 be different from that of the discharge head 10 in the main scanning direction Ds. For example, the ultraviolet irradiator 40 may be disposed at the right side of the discharge head 10 in the main scanning direction Ds.

In the above embodiment, the ultraviolet irradiator 40 irradiates the predefined printing area R1 of the recording medium W with ultraviolet rays and ink is discharged on the area R2 at the upstream side of the printing area R1 in the conveyance direction, when the carriage 3 is moved from the right side to the left side in the main scanning direction Ds. However, it is not indispensable to discharge ink on the area R2.

The first discharge process, the conveyance of the recording medium, the second discharge process, and the irradiation process in the third scan may be executed a plurality of times in this order. The irradiation process in the third scan may be executed simultaneously with the first discharge process to be executed next to the irradiation process in the third scan. In this case, the third scan and the first scan to be executed next to the third scan are the same scan. The ultraviolet irradiator 40 irradiates the predefined printing area R1 of the recording medium W with ultraviolet rays (the irradiation process) and ink is discharged on the area R2 at the upstream side of the printing area R1 in the conveyance direction (the first discharge process), when the carriage 3 is moved in the main scanning direction Ds (the third scan, the first scan).

In the above embodiment, a set of the discharge head 10 and the ultraviolet irradiator 40 is adopted. The present disclosure, however, is not limited thereto. Two sets of the discharge heads 10 and the ultraviolet irradiators 40 may be adopted.

In the above embodiment, the controller 71 receives the printing job from the external computer 200 via the network interface 70. The controller 71 executes the surface uniformizing printing when the instruction that makes the flag of the surface uniformizing printing the on-state is written in the header of the printing job. The present disclosure, however, is not limited thereto. For example, when a user instructs the surface uniformizing printing by using the operation keys 4 or the display 5 in the image recording apparatus 1, the controller 71 may cause the RAM 72 to store that the flag designating the surface uniformizing printing is on. Then, the controller 71 may refer to the flag designating the surface uniformizing printing stored in the RAM 72, and may execute the surface uniformizing printing. Or, the following configuration may be adopted. That is, when the controller 71 has received a printing job from the external computer 200 via the network interface 70, and when the information in which the flag designating the surface uniformizing printing is on is written in the header of the printing job, the flag designating the surface uniformizing printing stored in the RAN 72 is made to be on.

What is claimed is:

1. A liquid discharge apparatus, comprising:

a discharge head including a plurality of nozzles and configured to discharge an ultraviolet curable ink from the nozzles on a recording medium;

an ultraviolet irradiator disposed at a position different from the discharge head in a first direction and configured to irradiate the ink discharged on the recording medium with ultraviolet light;

a carriage configured to scan in the first direction, the discharge head and the ultraviolet irradiator being carried on the carriage; and a controller configured to control the discharge head, the ultraviolet irradiator, and the carriage, wherein the controller is configured to:

control the carriage and the discharge head to execute a first discharge process of discharging the ink on a predefined printing area of the recording medium in a first scan in which the carriage scans in the first direction, without causing the ultraviolet irradiator to irradiate the ink discharged on the predefined printing area in the first discharge process with the ultraviolet light;

after the first discharge process, control the carriage and the discharge head to execute a second discharge process of discharging the ink on the predefined printing area, on which the ink has been discharged by the first discharge process, in a second scan in which the carriage scans in the first direction, without causing the ultraviolet irradiator to irradiate the ink discharged on the predefined printing area in the second discharge process with the ultraviolet light, the second scan being different from the first scan; and after the second discharge process, control the carriage and the ultraviolet irradiator to irradiate the ink discharged on the predefined printing area by the first discharge process and the second discharge process with the ultraviolet light in a third scan in which the carriage scans in the first direction, the third scan being different from the second scan.

2. The liquid discharge apparatus according to claim 1, further comprising a conveyor configured to convey the recording medium in a second direction orthogonal to the first direction, wherein the nozzles of the discharge head form a first nozzle group and a second nozzle group that is disposed at a position different from the first nozzle group in the second direction, the controller is configured to:

in the first discharge process, control the discharge head to discharge the ink from the first nozzle group of the discharge head, and in the second discharge process, control the discharge head and the ultraviolet irradiator to discharge the ink from the second nozzle group of the discharge head in a state where the irradiation of the ultraviolet light is stopped.

3. The liquid discharge apparatus according to claim 2, wherein the controller is configured to:

control the carriage to scan in the first direction so that the ultraviolet irradiator and the discharge head pass over the recording medium in this order in the first scan of the first discharge process; and control the carriage to scan in the first direction so that the discharge head and the ultraviolet irradiator pass over the recording medium in this order in the second scan of the second discharge process.

4. The liquid discharge apparatus according to claim 2, wherein the nozzles of the discharge head are aligned in the second direction to form a plurality of nozzle rows, the nozzle rows being arranged in the first direction, and a boundary between the first nozzle group and the second nozzle group is set to a center in the second direction of the nozzle rows.

5. The liquid discharge apparatus according to claim 4, wherein the controller is configured to control the conveyor to convey the recording medium in the second direction by a length in the second direction of the first nozzle group, after the first discharge process is completed and before the second discharge process is started.

6. The liquid discharge apparatus according to claim 5, wherein the controller is configured to control the discharge head, the ultraviolet irradiator, the carriage, and the conveyor to execute:

the first discharge process, the conveyance of the recording medium, the second discharge process, and the ultraviolet irradiation in the third scan a plurality of times in this order, and the ultraviolet irradiation in the third scan simultaneously with the first discharge process to be executed next to the ultraviolet irradiation in the third scan.

7. The liquid discharge apparatus according to claim 2, wherein in the first scan of the first discharge process, the controller is configured to control the discharge head, the ultraviolet irradiator, and the carriage to discharge the ink from the first nozzle group of the discharge head in the state where the irradiation of the ultraviolet light is stopped.

8. The liquid discharge apparatus according to claim 1, wherein in the third scan, the controller is configured to control the discharge head to discharge the ink on an area of the recording medium that is different from the predefined printing area.

9. The liquid discharge apparatus according to claim 1, further comprising a conveyor configured to convey the recording medium in a second direction orthogonal to the first direction, wherein the controller is configured to control the conveyor to stop, between the second discharge process and the ultraviolet irradiation in the third scan, the conveyance of the recording medium.

10. The liquid discharge apparatus according to claim 1, wherein the controller is configured to receive a printing job, and in a case that a flag designating surface uniformizing printing in the printing job received is on, the controller is configured to execute the first discharge process, the second discharge process, and the ultraviolet irradiation in the third scan.

11. The liquid discharge apparatus according to claim 9, wherein the controller includes a raster data dividing section configured to divide raster data, which is used for discharging liquid droplets of the ink to form an image on the recording medium, into raster data for the first discharge process and raster data for the second discharge process, in the case that the flag in the printing job received is on.

12. The liquid discharge apparatus according to claim 1, wherein the discharge head and the ultraviolet irradiator are arranged in the first direction.

13. The liquid discharge apparatus according to claim 9, wherein the discharge head and the ultraviolet irradiator are arranged at an identical position in the second direction.

14. The liquid discharge apparatus according to claim 1, wherein the controller is configured to:

in the first scan, control the carriage to scan from one side to the other side in the first direction, and in the second scan, control the carriage to scan from the other side to the one side in the first direction.

15. The liquid discharge apparatus according to claim 14, wherein in the third scan, the controller is configured to control the carriage to scan from the one side to the other side in the first direction.

16. The liquid discharge apparatus according to claim 1, wherein the controller is configured to control the carriage to execute the first scan, the second scan, and the third scan in this order, no scan is executed by the carriage between the first scan and the second scan, and no scan is executed by the carriage between the second scan and the third scan.

17. The liquid discharge apparatus according to claim 1, wherein in the third scan, the controller is configured to control the carriage, the discharge head, and the ultraviolet irradiator, such that irradiation of the ultraviolet light by the ultraviolet irradiator is executed on a downstream side in a scanning direction of the carriage with respect to the discharge head.

18. The liquid discharge apparatus according to claim 17, wherein the ultraviolet irradiator is disposed only on one side in the first direction with respect to the discharge head, and in the third scan, the controller is configured to control the carriage to scan in the scanning direction such that a position of the ultraviolet irradiator in the carriage is on the downstream side in the scanning direction with respect to a position of the discharge head in the carriage.

* * * * *